US011346177B2

(12) United States Patent
Turner et al.

(10) Patent No.: US 11,346,177 B2
(45) Date of Patent: May 31, 2022

(54) REPAIRABLE SEAL ASSEMBLIES FOR OIL AND GAS APPLICATIONS

(71) Applicant: Saudi Arabian Oil Company, Dhahran (SA)

(72) Inventors: Robert John Turner, Dhahran (SA); Brett W. Bouldin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 48 days.

(21) Appl. No.: 16/702,916

(22) Filed: Dec. 4, 2019

(65) Prior Publication Data

US 2021/0172279 A1 Jun. 10, 2021

(51) Int. Cl.

| | |
|---|---|
| ***E21B 33/12*** | (2006.01) |
| ***E21B 36/00*** | (2006.01) |
| ***E21B 33/138*** | (2006.01) |
| ***E21B 47/00*** | (2012.01) |

(52) U.S. Cl.

CPC ..... *E21B 33/1212* (2013.01); *E21B 33/138* (2013.01); *E21B 36/00* (2013.01); *E21B 47/00* (2013.01)

(58) Field of Classification Search

CPC ..... E21B 33/1212; E21B 47/00; E21B 36/00; E21B 33/12; E21B 29/10; E21B 33/138

See application file for complete search history.

(56) References Cited

U.S. PATENT DOCUMENTS

| | | | |
|---|---|---|---|
| 3,175,618 | A | 3/1965 | Lang et al. |
| 4,083,408 | A | 4/1978 | Milam |
| 4,349,781 | A | 9/1982 | Vozoff |
| 4,526,480 | A | 7/1985 | Ward |
| 4,907,763 | A | 3/1990 | Pinson |
| 5,375,622 | A | 12/1994 | Houston |
| 5,613,555 | A | 3/1997 | Sorem et al. |
| 6,044,906 | A | 4/2000 | Saltel |
| 6,273,189 | B1 | 8/2001 | Gissler et al. |
| 6,384,389 | B1 | 5/2002 | Spencer |
| 6,393,363 | B1 | 5/2002 | Wilt et al. |
| 6,426,917 | B1 | 7/2002 | Tabanou et al. |
| 6,474,414 | B1 | 11/2002 | Gonzalez et al. |

(Continued)

FOREIGN PATENT DOCUMENTS

| | | |
|---|---|---|
| CN | 201496028 | 6/2010 |
| CN | 102667530 | 9/2012 |

(Continued)

OTHER PUBLICATIONS

Aziz et al., "Surface-to-borehole TEM for reservoir monitoring," SEG-2011-1882, Society of Exploration Geophysicists, 2011 SEG Annual Meeting, Texas, Sep. 18-23, 2011, 5 pages.

(Continued)

*Primary Examiner* — Nicole Coy

(74) *Attorney, Agent, or Firm* — Fish & Richardson P.C.

(57) ABSTRACT

A repairable seal assembly for deployment at a wellbore includes an elongate body, a first seal carried by the elongate body and configured to seal against an adjacent surface, and a transitional component carried by the elongate body. The transitional component is adjustable from a first configuration in which the transitional component defines a gap between the transitional component and the adjacent surface to a second configuration in which the transitional component contacts the adjacent surface to form a second seal at the adjacent surface.

21 Claims, 7 Drawing Sheets

(56) References Cited

U.S. PATENT DOCUMENTS

| | | | |
|---|---|---|---|
| 6,578,638 | B2 | 6/2003 | Guillory et al. |
| 6,739,165 | B1 | 5/2004 | Strack |
| 6,799,633 | B2 | 10/2004 | McGregor |
| 6,831,470 | B2 | 12/2004 | Xie et al. |
| 6,845,819 | B2 | 1/2005 | Barrett et al. |
| 6,938,470 | B2 | 9/2005 | DiFoggio et al. |
| 6,993,979 | B2 | 2/2006 | Segeral |
| 7,063,143 | B2 | 6/2006 | Tilton et al. |
| 7,162,918 | B2 | 1/2007 | DiFoggio et al. |
| 7,317,989 | B2 | 1/2008 | DiFoggio et al. |
| 7,599,803 | B2 | 10/2009 | Scott |
| 7,675,813 | B2 | 3/2010 | Valero et al. |
| 7,908,930 | B2 | 3/2011 | Xie et al. |
| 7,934,552 | B2 | 5/2011 | Rovere |
| 8,106,791 | B2 | 1/2012 | Thompson et al. |
| 8,390,471 | B2 | 3/2013 | Coates et al. |
| 8,392,119 | B2 | 3/2013 | Alumbaugh et al. |
| 8,521,436 | B2 | 8/2013 | Agar |
| 8,638,103 | B2 | 1/2014 | Rosthal et al. |
| 8,680,866 | B2 | 3/2014 | Marsala et al. |
| 8,816,689 | B2 | 8/2014 | Colombo et al. |
| 8,901,931 | B2 | 12/2014 | Esmersoy |
| 8,947,093 | B2 | 2/2015 | Alumbaugh et al. |
| 9,116,105 | B2 | 8/2015 | Veneruso et al. |
| 9,121,237 | B2 | 9/2015 | Kumar |
| 9,441,997 | B2 | 9/2016 | Downie et al. |
| 9,708,882 | B2 | 7/2017 | Carragher et al. |
| 9,739,905 | B2 | 8/2017 | Sena |
| 10,067,255 | B2 | 9/2018 | Colombo et al. |
| 10,115,942 | B2 | 10/2018 | Qiao et al. |
| 2002/0178805 | A1 | 12/2002 | DiFoggio et al. |
| 2002/0178837 | A1 | 12/2002 | Brandt |
| 2004/0160223 | A1 | 8/2004 | McElhinney |
| 2007/0012437 | A1 | 1/2007 | Clingman et al. |
| 2007/0075890 | A1 | 4/2007 | Jackson |
| 2007/0170722 | A1 | 7/2007 | Reynolds et al. |
| 2007/0239402 | A1 | 10/2007 | Scott |
| 2008/0061510 | A1 | 3/2008 | Li et al. |
| 2008/0073077 | A1 | 3/2008 | Tunc et al. |
| 2008/0289813 | A1 | 11/2008 | Gewily et al. |
| 2009/0039889 | A1 | 2/2009 | Wilt et al. |
| 2009/0058226 | A1 | 3/2009 | Furuhata et al. |
| 2010/0259268 | A1 | 10/2010 | Zhang et al. |
| 2011/0001482 | A1 | 1/2011 | Alumbaugh et al. |
| 2011/0036569 | A1 | 2/2011 | Bass et al. |
| 2011/0308789 | A1 | 12/2011 | Zhang et al. |
| 2012/0018143 | A1 | 1/2012 | Lembcke |
| 2012/0191353 | A1 | 7/2012 | Wilt et al. |
| 2012/0293179 | A1 | 11/2012 | Colombo et al. |
| 2013/0068481 | A1 | 3/2013 | Zhou |
| 2013/0255370 | A1 | 10/2013 | Roux et al. |
| 2013/0300419 | A1 | 11/2013 | Hibbs |
| 2014/0136125 | A1 | 5/2014 | Agar et al. |
| 2014/0376332 | A1 | 12/2014 | Vigneaux et al. |
| 2015/0061684 | A1 | 3/2015 | Marsala et al. |
| 2015/0101817 | A1 | 4/2015 | White et al. |
| 2015/0369949 | A1 | 12/2015 | Cuevas et al. |
| 2015/0378044 | A1 | 12/2015 | Brooks |
| 2016/0177659 | A1 | 6/2016 | Voll et al. |
| 2017/0097441 | A1 | 4/2017 | Eiskamp |
| 2017/0146681 | A1 | 5/2017 | Cuevas et al. |
| 2017/0247971 | A1 | 8/2017 | Diaz |
| 2018/0313193 | A1 | 11/2018 | Gibb |

FOREIGN PATENT DOCUMENTS

| | | |
|---|---|---|
| GB | 2410090 | 7/2005 |
| GB | 2420869 | 6/2006 |
| GB | 2544695 | 5/2017 |
| GB | 2561255 | 10/2018 |
| GB | 2562811 | 11/2018 |
| JP | 2010156172 | 7/2010 |
| WO | WO 2001022041 | 3/2001 |
| WO | WO 02099247 | 12/2002 |
| WO | WO 2005085909 | 9/2005 |
| WO | WO 2011053714 | 5/2011 |
| WO | WO 2013005091 | 1/2013 |
| WO | WO 2015047399 | 4/2015 |
| WO | WO 2017009671 | 1/2017 |
| WO | WO 2017146593 | 8/2017 |

OTHER PUBLICATIONS

Colombo and McNeice, "Geophysical monitoring of waterflooding in Saudi Arabia: Methods and perspectives," SEG Annual Meeting Expanded Abstracts, SEG International Exposition and 87th Annual Meeting, Sep. 2017, 5 pages.

Colombo and McNeice, "Quantifying surface-to-reservoir electromagnetics for waterflood monitoring in a Saudi Arabian carbonate reservoir," Geophysics vol. 78, No. 6, Nov.-Dec. 2013, 17 pages.

Colombo and McNeice, "Surface to borehole CSEM for waterflood monitoring in a supergiant oilfield in Saudi Arabia: data analysis," 2018, 5 pages.

Colombo and Rovetta, "Geophysical joint inversion with multiple coupling operators," 88th Annual international Meeting, SEG Expanded Abstracts, 2018, 5 pages.

Colombo et al, "Application of pattern recognition techniques to long-term earthquake prediction in central Costa Rica," Engineering Geology 48 (1997), pp. 7-18.

Colombo et al., "Feasibility study of surface-to-borehole CSEM for oil-water fluid subsition in Ghawar Field," KMS Technologies—KJT Enterprises, Inc., Saudi Arabia, Geo 2010, poster, 4 pages.

Cox et al., "Realistic Assessment of Proppant Pack Conductivity for Material Section," SPE-84306-MS, presented at the Annual Technical Conference, Oct. 5-8, 2003, Society of Petroleum Engineers, 12 pages.

Dogru et al., "A next-generation parallel reservoir simulator for giant reservoirs," SPE Journal Paper 119272, presented at the Reservoir Simulation Symposium in the Woodlands, Texas, Feb. 2009, 29 pages.

Gillard et al., "A New Approach to Generating Fracture Conductivity," SPE-135034-MS, presented at the SPE Annual Technical Conference and Exhibition, Sep. 19-22, 2010, Society of Petroleum Engineers 14 pages.

Gomaa et al., "Computational Fluid Dynamics Applied to Investigate Development and Optimization of Highly Conductive Channels within the Fracture Geometry," SPE-179143-MS, Society of Petroleum Engineers, SPE Production & Operations, 32, Nov. 4, 2017, 12 pages.

Gomaa et al., "Improving Fracture Conductivity by Developing and Optimizing a Channels Within the Fracture Geometry: CFD Study," SPE-178982-MS, Society of Petroleum Engineers, SPE International Conference and Exhibition on Formation Damage Control, Feb. 24-26, 2016, 25 pages.

Gonzalez et al., "Downhole Viscosity Measurement Platform using Tuning Fork Oscillators," Copyright 2015, 4 pages.

Heinisch et al., "Resonant Steel Tuning Forks for precise inline viscosity and mass density measurements in harsh environments," Proceedia Engineering, vol. 87, Dec. 2014, pp. 1139-1142.

Kern et al., "Propping Fractures With Aluminum Particles," SPE-1573-G-PA, Journal of Per. Technology, vol. 13, No. 6, Jun. 1961, pp. 583-589, 7 pages.

McNeice and Colombo, "3D inversion of surface to borehole CSEM for waterflood monitoring," 2018, 4 pages.

Meyer et al., "Theoretical Foundation and Design Formulae for Channel and Pillar Type Propped Fractures—A Method to Increase Fracture Conductivity," SPE-170781-MS, Society of Petroleum Engineers, SPE Annual Technical Conference and Exlribition, Oct. 27-29, 2014, 25 pages.

Palisch et al., "Determining Realistic Fracture Conductivity and Understanding its Impact on Well Performance—Theory and Field Examples," SPE-106301-MS, Society of Petroleum Engineers, SPE Hydraulic Fracturing Technology Conference, Jan. 29-31, 2007, 13 pages.

Poollen et al., "Hydraulic Fracturing—FractureFlow Capacity vs Well Producity," SPE-890-G, presented at 32nd Annual Fall Meet-

(56) References Cited

OTHER PUBLICATIONS ing of Society of Petroleum Engineers, Oct. 6-9, 1957, published as Petroleum Transactions AIME vol. 213, 1958, 5 pages.
Raza et al., "Liquid Density Measurement using Tuning Fork," International Journal of Current Engineering and Technology, vol. 5, No. 1, Feb. 2015, 4 pages.
Sabbione et al, "Automatic first-breaks picking: New strategies and algorithms," Geophysics, 75(4), pp. 67-76, Jul. 2009.
Schmidhuber et al, "Deep learning in neural networks: An overview: Neural Networks," Elsevier, Neural Networks, vol. 61, Jan. 2015, pp. 85-117.
Tinsley and Williams, "A new method for providing increased fracture conductivity and improving stimulation results," SPE-4676-PA, Journal of Petroleum Technology, vol. 27, No. 11, Nov. 1975, 7 pages.
Vincent, "Examining Our Assumptions—Have Oversimplifications Jeopardizedour Ability to Design Optimal Fracture Treatments," SPE-119143-MS, presented at the SPE Hydraulic Fracturing Technology Conference, Jan. 19-21, 2009, 51 pages.
Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.
Walker et al., "Proppants, We Still Don't Need No Proppants—A Perspective of Several Operators," SPE-38611-MS, presented at the SPE Annual Technical Conference and Exhibition, Sep. 27-30, 1995, 8 pages.
Williams, "A new method for providing increased fracture conductivitv and improving stimulation results," SPE-4676-PA, Journal of Petroleum Technology, vol. 27, No. 11, MO 1975, (1319-1325).
Wilt et al., "Cross-borehole electromagnetic induction for reservoir characterization," SPE-23623-MS, 61st Annual International Meeting, SEG Expanded Abstracts, Mar. 8-11, 1991, 4 pages.
Wilt et al., "Crosswell electromagnetic tomography: System design consideration and field results," Geophysics, vol. 60, Mar. 1991, 4 pages.
Zheng et al., "Design and Theoretical Analysis of a Resonant Sensor for Liquid Density Measurement," Sensors, Jun. 8, 2012; No. 12, pp. 7905-7916.
PCT International Search Report and Written Opinion in International Appln. No. PCT/US2020/062914, dated Feb. 19, 2021, 14 pages.

REPAIRABLE SEAL ASSEMBLIES FOR OIL AND GAS APPLICATIONS

TECHNICAL FIELD

This disclosure relates to repairable seal assemblies installed within completion systems at subterranean wellbores. Such repairable seal assemblies include eutectic metal alloy materials that can be employed to provide backup sealing capability in the event that seal stacks of the sealing assemblies should fail.

BACKGROUND

A pairing of a seal assembly and a polished bore receptacle (PBR) is commonly used in oil industry completions to allow tubing movement and easy replacement of an upper completion during workover operations. If seal stacks on the seal assembly fail, then a wellbore at which the pairing is installed will have tubing to annulus communication and therefore be classified as unsafe. For example, flow of wellbore fluids into an annulus causes a pressure increase in the annulus. Such direct tubing pressure within the annulus compromises the integrity of the wellbore, as exposure to wellbore fluids accelerates corrosion. When such communication occurs, an operator may repair the wellbore to return the wellbore to a safe operating condition. Conventional repairs require a hoist or a rig workover because the completion has to be pulled from the wellbore, and a new upper completion with a replacement seal assembly must be run in. In many cases, this requires the wellbore to be shut in and plugged to allow the annulus pressure to be bled down. In some examples, a queue time to schedule a workover is several months, or even longer for offshore platforms.

A dirty, chemically and mechanically hostile environment can hinder performance of a seal assembly, which is why seal assemblies include multiple seal stacks. For example, if one seal stack fails, then another seal stack can perform the sealing duty. A seal assembly may experience one or more of several modes of damage, including running in hole (RIH) damage, stab-in damage, exit damage as the seal assembly is pulled out of a PBR, wear due to repeated stroking, and extrusion damage. RIH damage results from a seal assembly picking up mud and other well debris prior to being located in the PBR while being run in wellbore fluids. Stab-in damage involves cutting or otherwise damaging seal assembly components during the initial process of locating (for example, aligning) and landing the seal assembly in the PBR. In some examples, wear due to repeated stroking may occur if the seal assembly is left in a dynamic condition, such as a condition involving a change in a temperature or pressure of the wellbore (for example, shutting in the well) that results in tubing movement. Extrusion damage may result as elastomeric components of the seal assembly are extruded over the course of multiple pressure and temperature cycles, despite a design of the seal assembly (for example, a number of material types and a number of seal stacks) being matched to a duty of the wellbore. Conventional repair methods do not provide an in-situ approach. Rather, a pull tubing workover is the only repair option that is available to address a failed seal assembly.

SUMMARY

This disclosure relates to repairable seal assemblies that are designed to seal against a receptacle that is attached to and located uphole of a downhole tube section of a completion tubing within a subterranean wellbore. For example, a seal assembly may include a cylindrical body (e.g., a mandrel), one or more sets of elastomeric seals that surround the cylindrical body respectively at one or more first axial positions, one or more metal rings that surround the cylindrical body respectively at one or more second axial positions, and anchors that surround the cylindrical body at third axial locations between the first and second axial locations to separate the one or more metal rings from the one or more elastomeric seals.

The one or more metal rings are made of a eutectic material (e.g., a metal alloy designed to have a relatively low melting point that is above a reservoir temperature of the wellbore). The low melting point allows the eutectic material to be easily melted without damaging the other metal components (for example, typically steel components) in the completion tubing. Accordingly, the one or more metal rings are in a solid state at relatively low temperatures and in a liquid state at temperatures above the melting point of the eutectic material. In an initial (e.g., non-operational) configuration, the one or more metal rings are in a solid state and have an outer diameter that is less than an inner diameter of the receptacle, such that the one or more metal rings do not initially seal against the receptacle.

The elastomeric seals have an outer diameter that is about equal to an inner diameter of the receptacle such that the elastomeric seals seal against the receptacle initially and throughout completion and production operations carried out at the wellbore. Such sealing can prevent wellbore fluids that have flowed from the downhole tube section into the receptacle from exiting the receptacle into an annular space defined between an uphole tube portion of the completion tubing and a surrounding casing. In some instances, one or more of the elastomeric seals can fail, such that the wellbore fluids leak out of the receptacle and into the annular space, where the wellbore fluids can compromise an integrity of the casing. In conventional sealing systems, such failure currently requires a rig operation to replace a completion to perform a repair of the sealing system.

Once a failure has occurred at an elastomeric seal, a heater can be passed through the cylindrical body of the sealing assembly to melt a nearby metal ring surrounding the cylindrical body to cause the metal ring to melt into a liquid state. In a liquid state, the eutectic material flows downward along the cylindrical body, and spreads radially from the cylindrical body to the inner diameter of the receptacle. The eutectic material cools from the liquid state to a solid state in which the eutectic material forms a metal ring with an outer diameter that is about equal to the inner diameter of the receptacle to effect a metal-to-metal seal between the receptacle and the cylindrical body of the sealing assembly.

In one aspect, a repairable seal assembly for deployment at a wellbore includes an elongate body, a first seal carried by the elongate body and configured to seal against an adjacent surface, and a transitional component carried by the elongate body. The transitional component is adjustable from a first configuration in which the transitional component defines a gap between the transitional component and the adjacent surface to a second configuration in which the transitional component contacts the adjacent surface to form a second seal at the adjacent surface.

Embodiments may provide one or more of the following features.

In some embodiments, the transitional component has an annular shape.

In some embodiments, the transitional component is made of a metal alloy that has a melting point in a range of about 90° C. to about 300° C.

In some embodiments, the transitional component is configured to be melted by a heater from the first configuration to the second configuration.

In some embodiments, the transitional component is in a solid state in the first and second configurations, and the transitional component is in a liquid state during a transitional period that occurs between a first period in which the transitional component is in the first configuration and a second period in which the transitional component is in the second configuration.

In some embodiments, the transitional component has a melting point in a range of about 20° C. to about 200° C. above a maximum expected operational temperature at the wellbore.

In some embodiments, the elongate body defines a lumen sized to allow passage of a heater.

In some embodiments, the transitional component has a first diameter and a first length in the first configuration, and the transitional component has a second diameter and a second length in the second configuration, wherein the first diameter is less than the second diameter, and wherein the first length is greater than the second length.

In some embodiments, the second seal is arranged to fluidically isolate a downhole region of a pipe surrounding the repairable seal assembly within the wellbore from an uphole annulus within the pipe.

In some embodiments, the second seal provides metal-to-metal sealing with the adjacent surface.

In some embodiments, the repairable seal assembly of claim further includes one or more additional first seals carried by the elongate body.

In some embodiments, the repairable seal assembly further includes one or more additional transitional components carried by the elongate body.

In some embodiments, the adjacent surface is an inner surface provided by a receptacle sized to receive the seal assembly.

In some embodiments, the adjacent surface is an outer surface provided by a tube sized to be received within the seal assembly.

In some embodiments, the repairable seal assembly includes one or more spacers arranged to support the first seal.

In some embodiments, the repairable seal assembly further includes two support members arranged at opposite ends of the transitional component.

In another aspect, a completion system installed at a wellbore includes a tubular component providing an interface and a repairable seal assembly positioned adjacent the interface. The seal assembly includes an elongate body, a first seal carried by the elongate body and configured to seal against the interface, and a transitional component carried by the elongate body. The transitional component is adjustable from a first configuration in which the transitional component defines a gap between the transitional component and the interface to a second configuration in which the transitional component contacts the interface to form a second seal at the interface.

Embodiments may provide one or more of the following features.

In some embodiments, the transitional component is made of a metal alloy that has a melting point in a range of about 90° C. to about 300° C.

In some embodiments, the transitional component is configured to be melted from the first configuration to the second configuration.

In some embodiments, the tubular component includes a receptacle sized to receive the repairable seal assembly, and the interface includes an inner surface of the tubular component.

In some embodiments, the tubular component includes a completion tubing sized to fit within the repairable seal assembly, and the interface includes an outer surface of the completion tubing.

In another aspect, a seal assembly for deployment at a wellbore includes an elongate body and a transitional component carried by the elongate body and being adjustable from a first configuration in which the transitional component defines a gap between the transitional component and an adjacent surface to a second configuration in which the transitional component contacts the adjacent surface to form a seal at the adjacent surface.

In another aspect, a method of sealing a tubing system installed at a wellbore includes forming a first seal between a sealing element carried by an elongate body and a surface adjacent the elongate body, determining a failure of the first seal at the surface, adjusting a transitional component carried by the elongate body from a first configuration in which the transitional component defines a gap between the transitional component and the surface to a second configuration in which the transitional component contacts the surface, and forming a second seal between the transitional component in the second configuration and the surface.

In some embodiments, the transitional component has an annular shape.

In some embodiments, the transitional component is made of a metal alloy that has a melting point in a range of about 90° C. to about 300° C.

In some embodiments, the method further includes deploying a heater to the transitional component to melt the transitional component from the first configuration to the second configuration.

In some embodiments, the transitional component is in a solid state in the first and second configurations, and the method further includes melting the transitional component to a liquid state during a transitional period that occurs between a first period in which the transitional component is in the first configuration and a second period in which the transitional component is in the second configuration.

In some embodiments, the transitional component has a melting point in a range of about 20° C. to about 200° C. above a maximum expected operational temperature at the wellbore.

In some embodiments, the method further includes deploying a heater to a lumen of the elongate body.

In some embodiments, the transitional component has a first diameter and a first length in the first configuration, and the transitional component has a second diameter and a second length in the second configuration, wherein the first diameter is less than the second diameter, and wherein the first length is greater than the second length.

In some embodiments, the second seal is arranged to fluidically isolate a downhole region of a pipe surrounding the second seal within the wellbore from an uphole annulus within the pipe.

In some embodiments, the method further includes providing metal-to-metal sealing between the second seal and the surface.

In some embodiments, the surface is an inner surface provided by a receptacle sized to receive a seal assembly that includes the first and second seals.

In some embodiments, the surface is an outer surface provided by a tube sized to be received within a seal assembly that includes the first and second seals.

The details of one or more embodiments are set forth in the accompanying drawings and description. Other features, aspects, and advantages of the embodiments will become apparent from the description, drawings, and claims.

DETAILED DESCRIPTION

Figure 1:
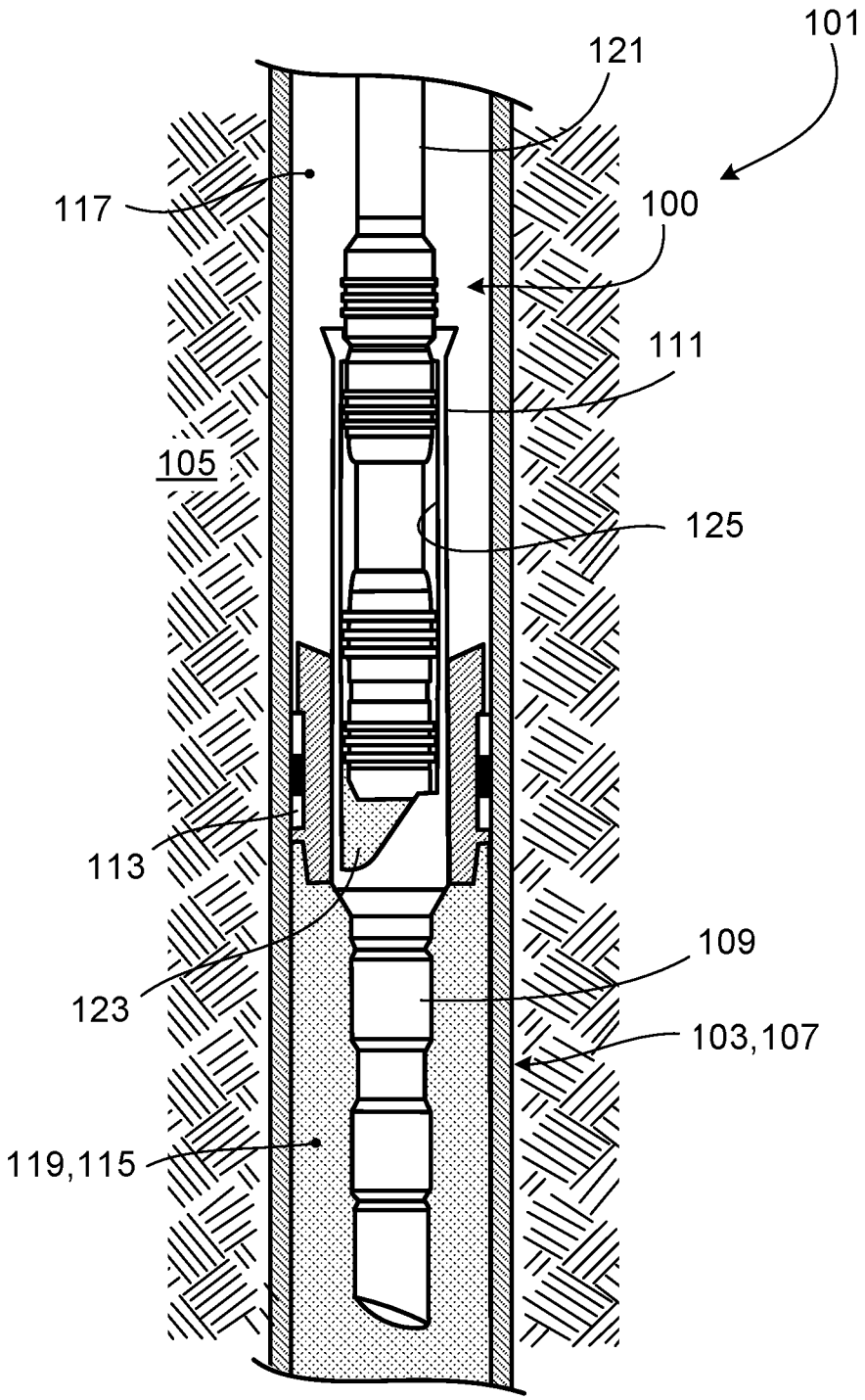
FIG. 1 is a side cross-sectional cutaway view of an example completion tubing system including an example seal assembly.

FIG. 1 illustrates a portion of an example completion tubing system 101 installed within a wellbore 103 of a rock formation 105. The completion tubing system 101 includes multiple casings 107 (for example, pipes cemented in place within the wellbore 103) that are centrally aligned within the wellbore 103 (although only one casing 107 is illustrated in FIG. 1). The completion tubing system 101 further includes a completion tubing 109 positioned within the casing 107, a polished bore receptacle (PBR) 111 extending from the completion tubing 109, a packer 113 that secures the completion tubing 109 to the casing 107 at a fixed position, and a seal assembly 100 disposed within the PBR 111.

The packer 113 seals against the casing 107 and accordingly defines an annulus 117 (for example, a substantially annular shaped volume) uphole of the packer 113 and a downhole region 115 located downhole of the packer 113. Sealing of the packer 113 against the casing 107 prevents any wellbore fluid 119 within the downhole region 115 of the casing 107 from flowing upward around an outer edge of the packer 113 and into the annulus 117. Wellbore fluid 119 within the downhole region 115 may flow into a lumen 123 of the completion tubing 109. The seal assembly 100 seals against an inner surface 125 of the PBR 111 to prevent any wellbore fluid 119 within the completion tubing 109 from flowing upward around an outer edge of the seal assembly 100 and into the annulus 117.

The PBR 111 is a female completion component that is bored for receiving the seal assembly 100 and is typically made of one or more metals. The PBR 111 may be deployed into the wellbore 103 on a deployment line 121 (for example, drill pipe or tubing). In some examples, the seal assembly 100 and the PBR 111 are run into the wellbore 103 in a single trip using shear pins that are later released. In other examples, the PBR 111 is run into the wellbore 103 on a lower completion assembly in a first trip, and the seal assembly 100 is run into the wellbore 103 (for example, stabbed into the PBR 111) in a subsequent, second trip. A pairing of the seal assembly 100 and the PBR 111 are typically landed in the wellbore 103 in compression such that the seal assembly 100 does not move during normal production activities. Substantially stationary positioning of the seal assembly 100 may prevent or minimize wear of the seal assembly 100 and increase a life of the seal assembly 100.

When stimulation activities are performed at the wellbore 103, a low temperature, relatively cool stimulation fluid being pumped into the wellbore 103 from the surface causes the completion tubing 109 to contract, such that the seal assembly 100 strokes in an uphole direction within the PBR 111 in a dynamic state. In some examples, the PBR 111 limits tensile stresses in the completion tubing 109 as compared to a fixed string that lacks a PBR. Once the relatively cool stimulation fluid is no longer pumped and the wellbore 103 is returned to a production state, the seal assembly 100 returns to its initial landed position in a static state.

Figure 2:
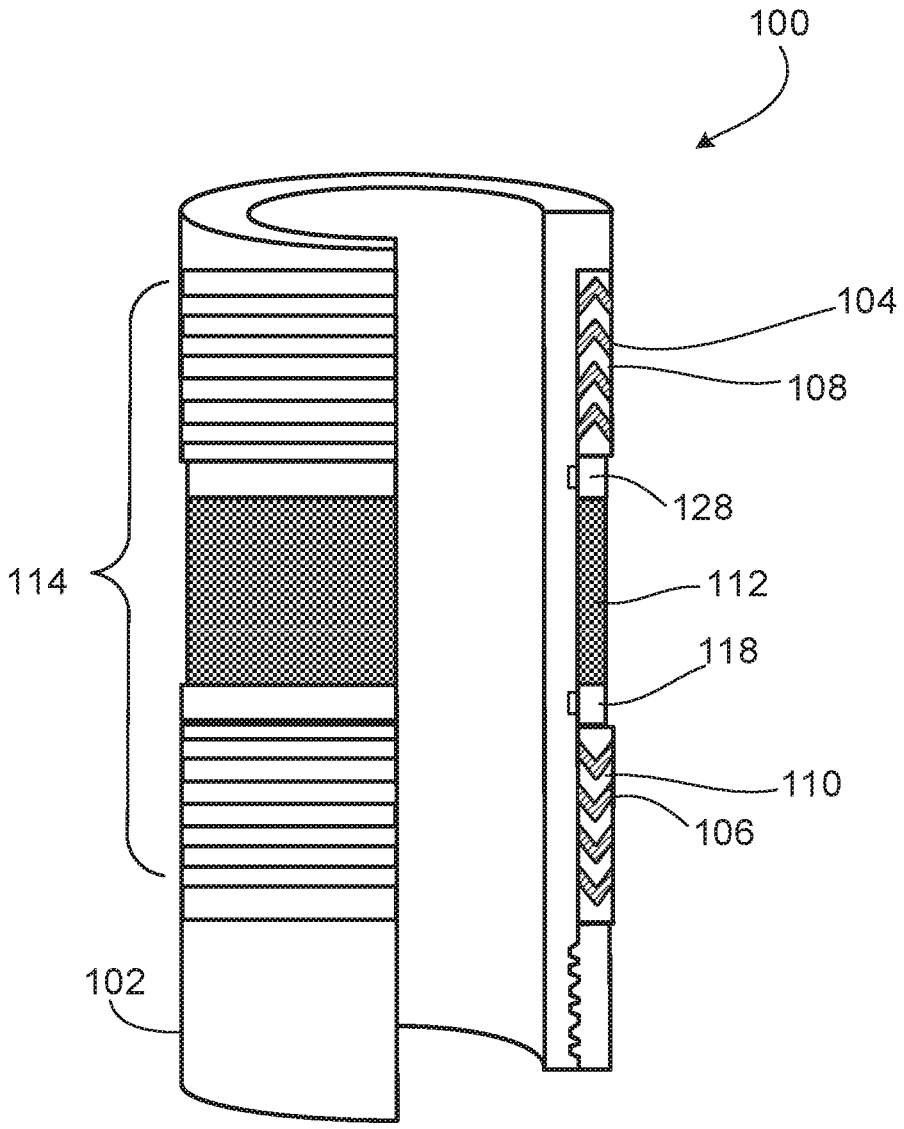
FIG. 2 is a perspective cutaway view of a portion of the seal assembly of FIG. 1.

FIG. 2 illustrates a cutaway view of the seal assembly 100. The seal assembly 100 is a repairable system that may be installed at wellbores at which there is no tubing movement or at wellbores at which dynamic operations are carried out. The seal assembly 100 includes a body 102 (for example, a mandrel) that carries a seal stack 114. The seal stack 114 includes multiple opposing seals 104, 106, multiple opposing metal spacers 108, 110, a transition ring 112 located axially between the opposing seals 104, 106 and opposing spacers 108, 110, and two anchors 118, 128 that flank the transition ring 112. The body 102 of the seal assembly 100 has a generally cylindrical shape and is typically made of one or more metals. The body 102 typically has a length in a range of about 3 meters (m) to about 8 m and typically carries a total of six to ten seal stacks 114, although only one seal stack 114 is illustrated in FIG. 2. The seal stack 114 is preinstalled to the body 102 at manufacture A seal stack 114 is designed to seal against the inner surface 125 of the PBR 111 to prevent fluid communication between the lumen 123 of the completion tubing 109 and the annulus 117. The seals 104, 106 are elastomeric, v-shaped rings that are axially stacked. The seals 104, 106 are typically made of one or more materials, such as nitrile. The metal spacers 108, 110 are designed to support and maintain axial positions of the seals 104, 106 (for example, to maintain space between the seals 104, 106), but do not contribute to sealing, themselves. In some embodiments, each seal stack 114 of the seal assembly 100 includes three to eight seals 104, 106 and a corresponding number of metal spacers 108, 110. Sizing of the seal stacks 114 of the seal assembly 100 may depend on various design parameters of the completion tubing system 101.

The transition ring 112 is an adaptive component that provides a contingent, in situ repair mechanism that can be employed in the case that one or more of the seals 104, 106 of the seal stack 114 should fail. The transition ring 112 has a generally cylindrical shape and is made of a eutectic metal alloy that has a relatively low melting point that is above a maximum expected operational temperature. The maximum expected operational temperature may be a reservoir temperature of the wellbore 103 or a different temperature related to activities such as stimulation. The low melting point allows the transition ring 112 to be easily melted without damaging other components (for example, typically steel components) of the completion tubing system 101. For example, the transition ring 112 typically has a melting point in a range of about 90 degrees Celsius (° C.) to about 300° C., which is also in a range of about 20 degrees ° C. to about 200° C. higher than the maximum expected operational temperature. Example eutectic metal alloy materials from which the transition ring 112 may be made include a bismuth tin (Bi—Sn) alloy or other low melting point alloys that are typically made from a combination of two or more of the metals bismuth, lead, tin, cadmium and indium.

In an initial configuration (for example, a non-operational configuration), the transition ring 112 is in a solid state and has an outer diameter that is slightly less than an inner diameter of the PBR 111. Accordingly, the transition ring 112 defines an annular gap 126 (appearing larger than actual scale in FIG. 3 for illustration purposes) between the transition ring 112 and the inner surface 125 of the PBR 111 and does not contact the PBR 111 to seal against the PBR 111. In the initial configuration, as shown in FIG. 2, the outer diameter of the transition ring 112 is also less than the outer diameter of the seals 104, 106. The transition ring 112 is separated from the seals 104, 106 and supported by the metal anchors 118, 128, which are anchored to the body 102 and also provide support for the adjacent seals 104, 106.

Figure 3:
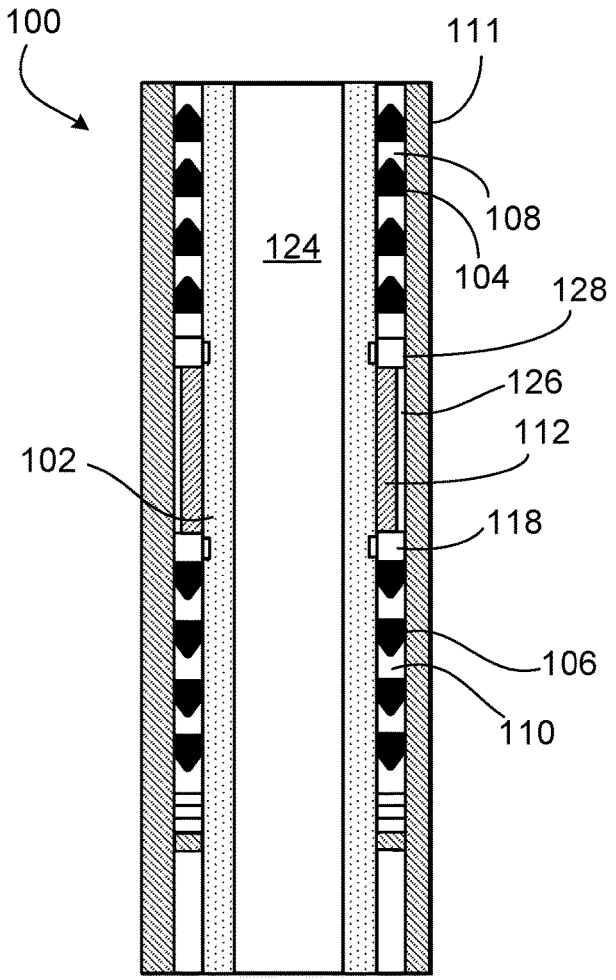
FIG. 3 is cross-sectional view of a portion of the completion tubing system of FIG. 1 in a first condition in which a transition ring of the seal assembly of FIG. 1 defines a gap between the transition ring and a surrounding receptacle.

FIG. 3 illustrates a first condition in which the seal assembly 100 operates normally such that the seals 104, 106 are intact and contact the inner surface 125 of the PBR 111 to seal against the PBR 111. The transition ring 112 is in the initial configuration (for example, a pre-melt configuration) in which the transition ring 112 defines the annular gap 126 between the transition ring 112 and the inner surface 125 of the PBR 111. Therefore, the transition ring 112 does not contact the PBR 111 and accordingly does not provide any sealing capability. The transition ring 112 has an initial length that extends from the uphole anchor 128 to the downhole anchor 118 and an initial outer diameter that is less than the inner diameter of the PBR 111.

Figure 4:
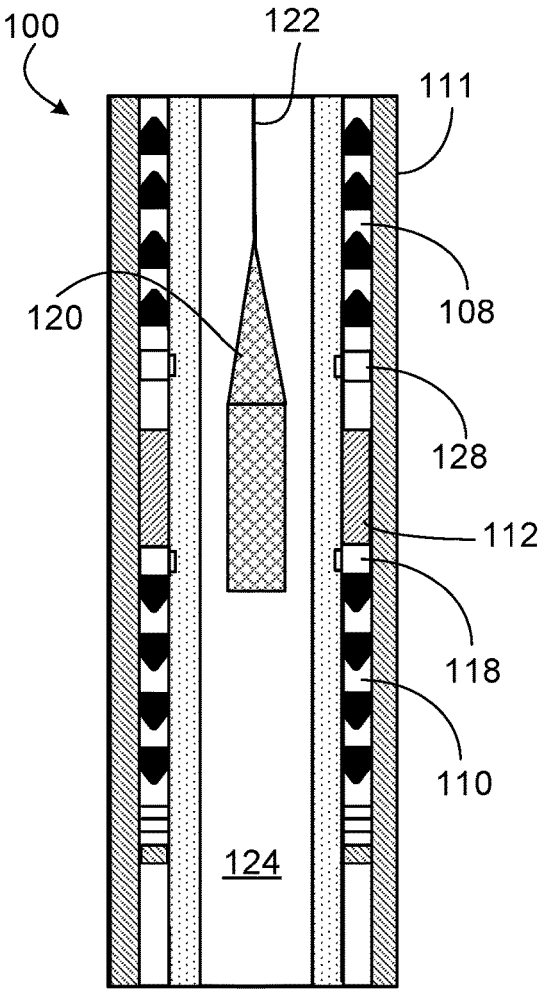
FIG. 4 is a cross-sectional view of the portion of the completion tubing system of FIG. 3 in a second condition in which the transition ring contacts the surrounding receptacle to form a seal.

In contrast, FIG. 4 illustrates a second condition in which one or more of the seals 104, 106 have failed. In particular, the seals 104, 106 are damaged or missing from the body 102 of the seal assembly 100 in the example illustration of FIG. 4. Given that the seals 104, 106 are no longer present to isolate the lumen 123 of the completion tubing 109 from the annulus 117, the transition ring 112 can be activated to provide such sealing functionality. In particular, a tubing heater 120 (for example, a thermite heater) is run on an electric line 122 using a casing collar locator (CCL) downhole into a lumen 124 of the body 102 and axially positioned adjacent the transition ring 112. In some examples, the tubing heater 120 may be run on wireline. A thermite reaction is initiated at the tubing heater 120, providing a large amount of energy to melt the transition ring 112 into a transitional configuration (for example, a melted configuration) in which the transition ring 112 is in a liquid state. For example, the tubing heater 120 may be heated to a temperature of about 100° C. or more above the melting point of the transition ring 112 to melt the transition ring 112 without damaging the other metal components of the completion tubing system 101.

In the transitional configuration, the molten material of the transition ring 112 has settled under the influence of gravity in a downhole direction towards the downhole anchor 118 and flows radially outward to the inner surface 125 of the PBR 111 such that a shape of the molten material (for example, in the form of an annular plug) is defined by the downhole anchor 118 and the PBR 111. The tubing heater 120 can be withdrawn from the seal assembly 100 to allow the molten material to cool back to a solid state and into a functional configuration in which the transition ring 112 effects a metal-to-metal seal with the inner surface 125 of the PBR to isolate the lumen 123 of the completion tube 109 and the downhole region 115 from the annulus 117.

In some examples, the functional configuration of the transition ring 112 is a permanent repair such that the wellbore 103 can safely and permanently undergo production activities with the seal assembly 100 in the repaired state, such that the need for a pull tubing workover is eliminated altogether. In other examples, the functional configuration of the transition ring 112 is a contingent repair that allows the wellbore 103 to safely undergo production activities with the seal assembly 100 in the repaired state until an upper completion workover operation can be scheduled. In either case, the functional configuration of the transition ring 112 allows production at the wellbore 103.

The functional configuration of the transition ring 112 can also defer and reduce workover costs in that a workover can be performed at the wellbore 103 as part of a pre-scheduled campaign as opposed to as an on-demand, stand-alone workover necessitated by failure of a seal stack 114. Accordingly, production can be maintained to meet production targets, and workover repairs can be better designed and executed. Such additional months of production can advantageously return scheduling of such workover repairs to the operator. For example, in some cases, a replace tubing workover also has remedial content to shut-off one zone and add other zones, which requires additional preparation and approval time. The functional configuration of the transition ring 112 can provide such additional time so that an optimal workover repair can be performed.

Figure 5:
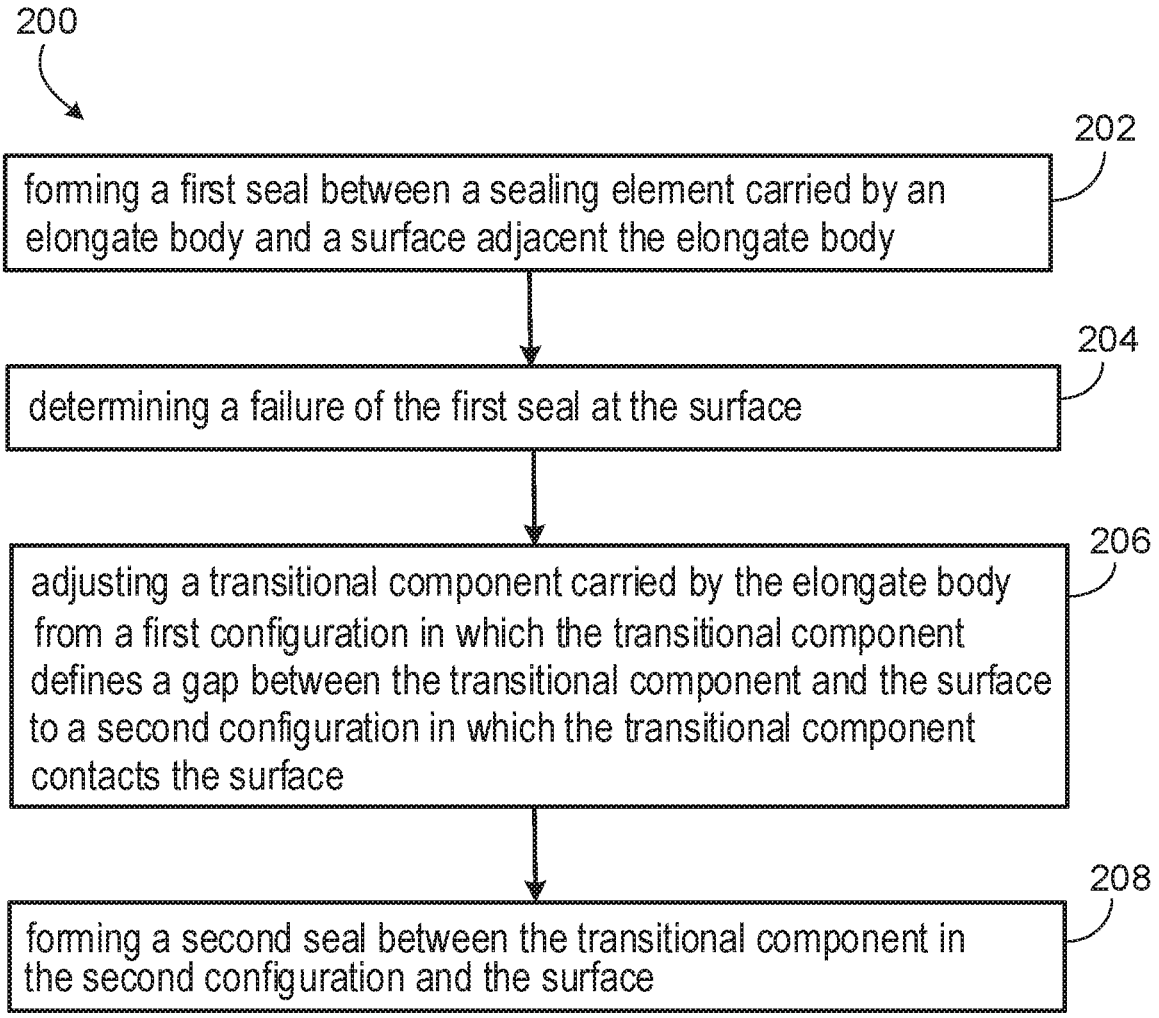
FIG. 5 is a flow chart illustrating an example method of sealing the completion tubing system of FIG. 1.

FIG. 5 is a flow chart illustrating an example method 200 of sealing a tubing system (for example, the completion tubing system 101) installed at a wellbore (for example, the wellbore 103). In some embodiments, the method 200 includes forming a primary seal between a sealing element (for example, a seal 104, 106) carried by an elongate body (for example, the body 102) and a surface (for example, the inner surface 125 of the PBR 111) adjacent the elongate body (202). In some embodiments, the method 200 further includes determining a failure of the primary seal at the surface (204). In some embodiments, the method 200 further includes adjusting a transitional component (for example, the transition ring 112) carried by the elongate body from a first configuration in which the transitional component defines a gap (for example, the gap 126) between the transitional component and the surface to a second configuration in which the transitional component contacts the surface (206). In some embodiments, the method 200 further includes forming a secondary seal between the transitional component in the second configuration and the surface (208).

Figure 6:
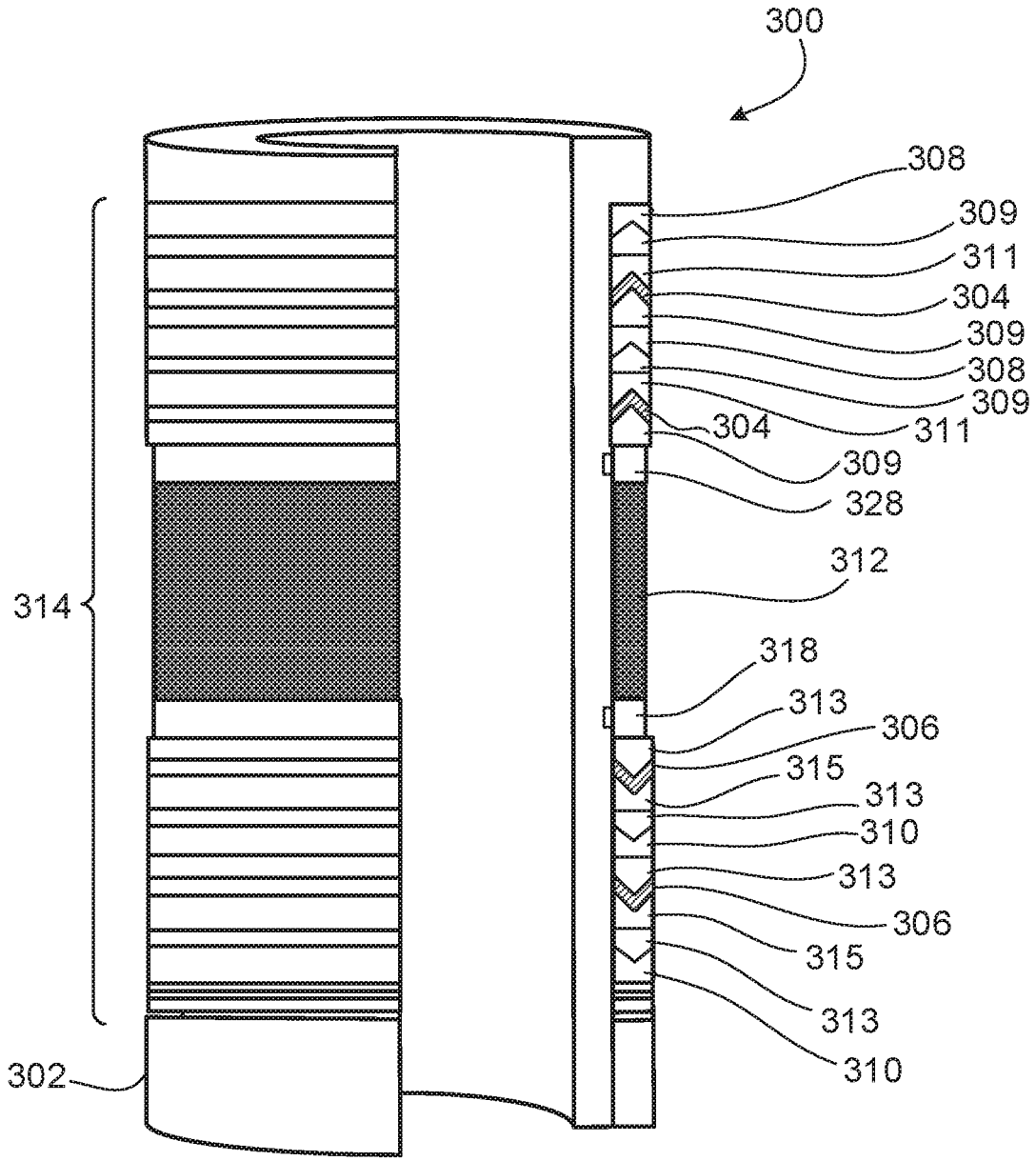
FIG. 6 is a perspective cutaway view of a portion of an example seal assembly including packing elements formed of differing materials.

While the seal assembly 100 has been described and illustrated with respect to certain dimensions, sizes, shapes, arrangements, materials, and methods 200, in some embodiments, a seal assembly that is otherwise substantially similar in construction and function to the seal assembly 100 may include one or more different dimensions, sizes, shapes, configurations, arrangements, and materials or may be utilized according to different methods. For example, FIG. 6 illustrates a cutaway view of a seal assembly 300 that includes a seal stack 314 with intermediate, ring-shaped packing elements 309, 311, 313, 315 distributed among seals 304, 306 and metal spacers 308, 310, 338, 340. The seal assembly 300 is otherwise substantially similar in construction and function the seal assembly 100. Accordingly, the seal assembly 300 may be paired with the PBR 111 or with the SBR 411 discussed below with respect to FIG. 7.

Accordingly, the seal assembly 300 is a repairable system that includes a body 302 (for example, a mandrel) carrying the seal stack 314. The seal stack 314 includes multiple opposing seals 304, 306, multiple opposing metal spacers 308, 310, 338, 340, the packing elements 309, 311, 313, 315, a transition ring 312 located axially between the opposing seals 304, 306 and opposing metal spacers 308, 310, 338, 340, and two anchors 318, 328 that flank the transition ring 312. The packing elements 309, 311, 313, 315 are typically made of differing materials and may be arranged such that the constituent materials sequentially transition from softer to harder. The hardness transition can prevent extrusion of the seals 304, 306 and thus help to maintain a sealing performance of the seals 304, 306. Example materials from which the packing elements 309, 311, 313, 315 may be made include synthetic rubber, fluoropolymer elastomer, tetrafluoroethylene (TFE), propylene, polytetrafluoroethylene (PTFE), polyphenylene sulfide, and polyether ether ketone (PEEK). The specific selection and arrangement of materials forming the packing elements 309, 311, 313, 315 may depend on one or more of various parameters at the wellbore 103, such as downhole pressure, downhole temperature, and time duty.

In some embodiments, a seal assembly that is otherwise substantially similar in construction and function to either of the seal assemblies 100, 300 may additionally include one or more debris stacks that are carried by a body of the seal assembly. Such debris stacks may include a series of multiple, stacked annular wiper rings that wipe away debris from the body of the seal assembly.

As discussed above, while the seal assembly 100 has been illustrated as including one seal stack 114, a seal assembly that is otherwise substantially similar in construction and function to the seal assembly 100 may include multiple seal stacks 114 such that multiple transition rings 112 are pre-installed at various axial locations along a body of the seal assembly. The multiple transition rings 112 may be activated simultaneously or at different times with a tubing heater to allow multiple attempts at repair and allow repairs to be performed at different times.

Figure 7:
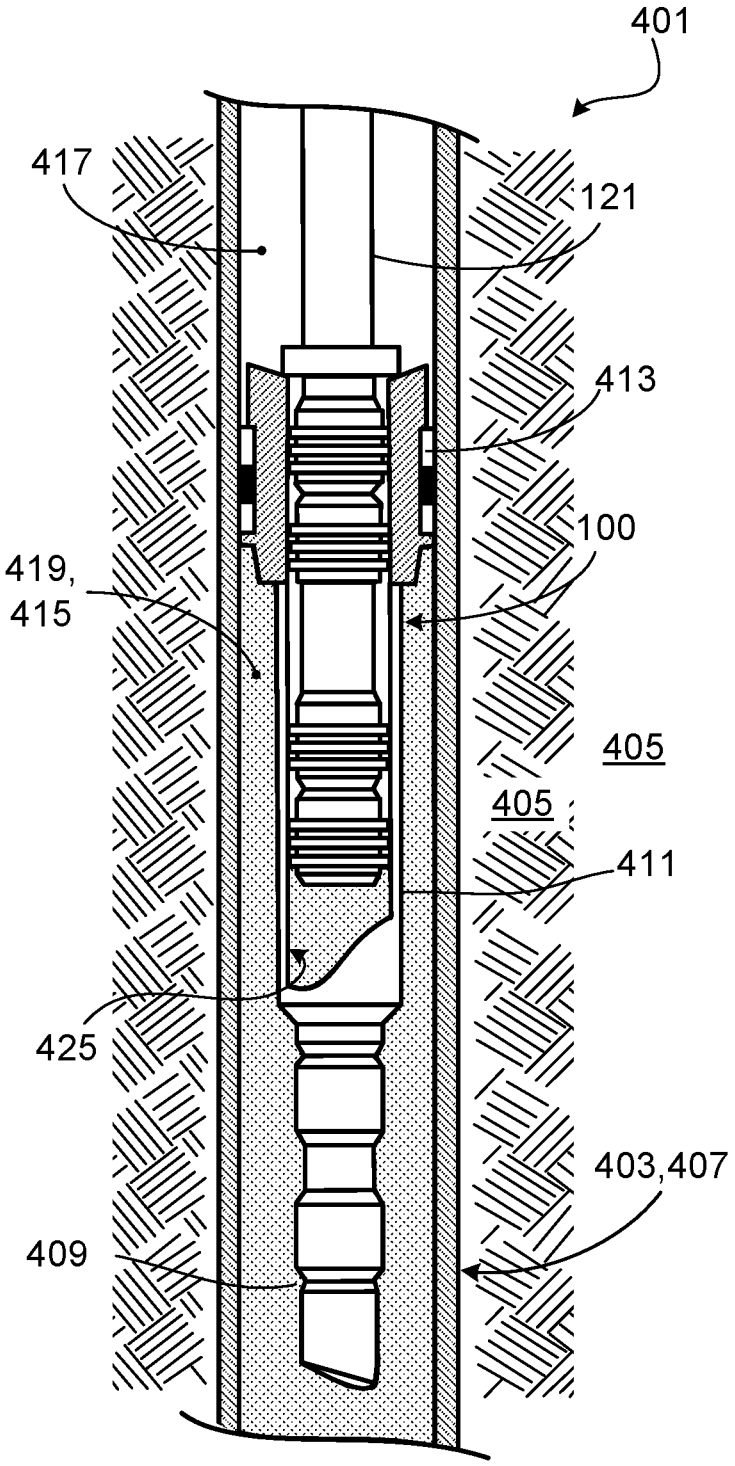
FIG. 7 is a side cross-sectional cutaway view of an example completion tubing system including a seal bore extension and the seal assembly of FIG. 1.

While the seal assembly 100 has been described and illustrated with respect to the PBR 111, in some embodiments, the seal assembly 100 may be paired with a seal bore extension (SBE) that is positioned downhole of the packer 113. For example, FIG. 7 illustrates an installation of the seal assembly 100 with such an SBE 411. An example completion tubing system 401 is installed within a wellbore 403 of a rock formation 405. In addition to the seal assembly 100 and the SBR 411, the completion tubing system 401 includes multiple casings 407 that are centrally aligned within the wellbore 403 (although only one casing 407 is illustrated), a completion tubing 409 that extends from the SBE 411, and a packer 413 that secures the completion tubing 409 to a casing 407 at a fixed position.

The packer 413 seals against the casing 407 and accordingly defines an annulus 117 uphole of the packer 113 and a downhole region 415 located downhole of the packer 413. Sealing of the packer 413 against the casing 407 prevents any wellbore fluid 419 within the downhole region 415 of the casing 407 from flowing upward around an outer edge of the packer 413 and into the annulus 417. Wellbore fluid 419 within the downhole region 415 may flow into a lumen 423 of the completion tubing 409. As with the PBR 111, the seal assembly 100 seals against an inner surface 425 of the SBE 411 to prevent any wellbore fluid 419 within the completion tubing 409 from flowing upward past an outer edge of the seal assembly 100 and into the annulus 417.

Figure 8:
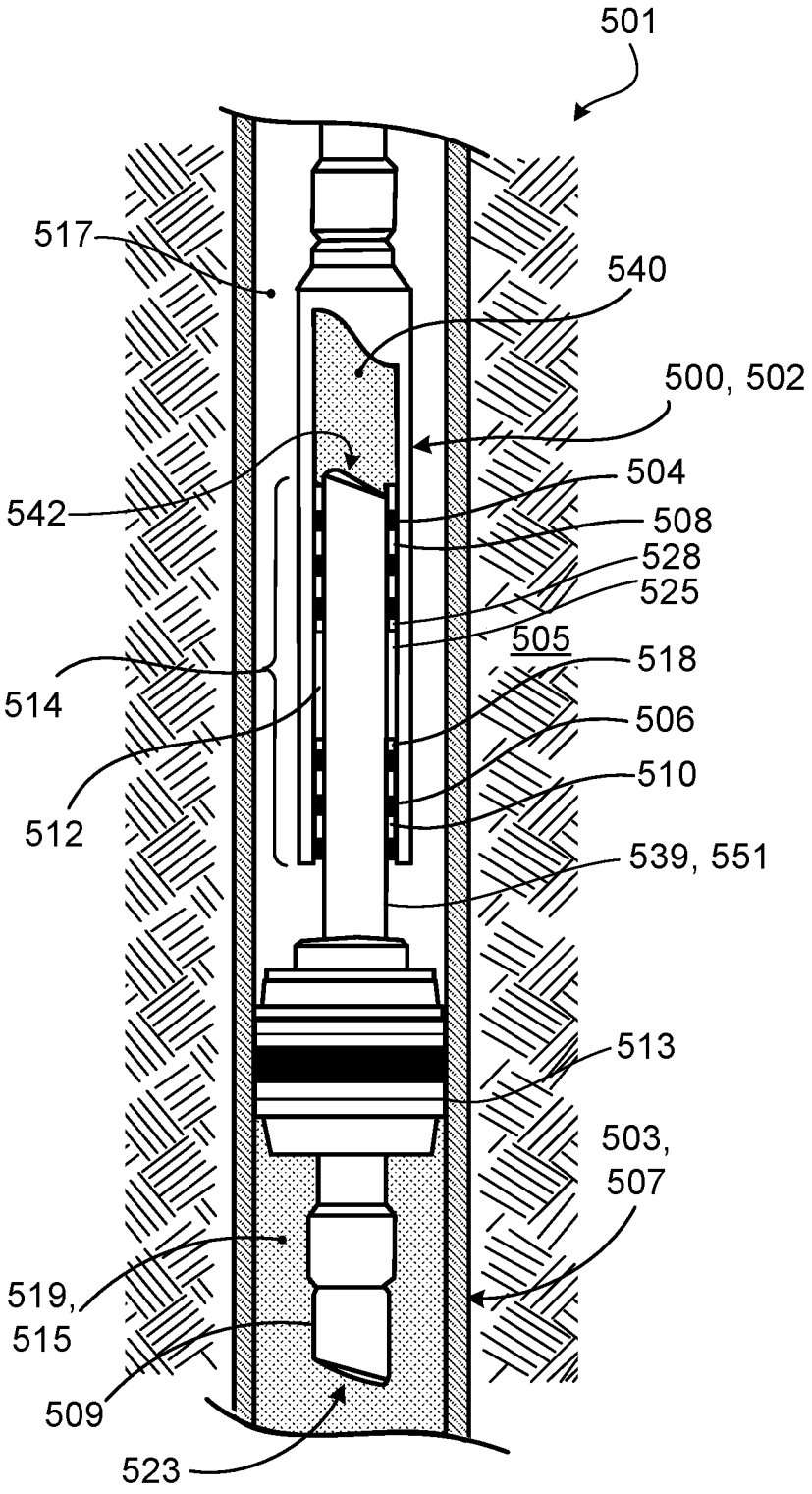
FIG. 8 is a side cross-sectional cutaway view of an example completion tubing system including an inverted seal assembly.

While the seal assembly 100 has been described and illustrated as a male completion component including annular seals 104, 106 and metal spacers 108, 110 that surround the body 102, in some embodiments, a seal assembly that is similar in function to the seal assembly 100 may be designed as a female completion component. For example, FIG. 8 illustrates such a seal assembly 500 that is provided as a tubing sealbore receptacle (TSR) (for example, an inverted PBR). An example completion tubing system 501 is installed within a wellbore 503 of a rock formation 505. In addition to the seal assembly 500, the completion tubing system 501 includes multiple casings 507 that are centrally aligned within the wellbore 503 (although only one casing 507 is illustrated), a packer 513, a slick joint 539 that extends from the packer 513 in an uphole direction, and a downhole completion tubing 509 that extends from the packer 513 in a downhole direction. The slick joint 539 has a circular outer cross-sectional shape and is machined to have a polished exterior surface. The slick joint 539 has a specified outer diameter within a tight tolerance for sealing against an interior seal stack 514 of the seal assembly 500. The packer 513 secures the completion tubing 509 and the slick joint 539 to the casing 507 at a fixed position.

The packer 513 also seals against the casing 507 and accordingly defines an annulus 517 uphole of the packer 513 and a downhole region 515 located downhole of the packer 513. The packer 513 seals against the casing 507 to prevent any wellbore fluid 519 within the downhole region 515 of the casing 507 from flowing in an uphole direction around an outer edge of the packer 513 and into the annulus 517. Wellbore fluid 519 within the downhole region 515 of the casing 507 may flow into a lumen 523 of the downhole completion tubing 509 and further upward into a lumen 542 of the slick joint 539.

The seal assembly 500 is carried on a deployment line 521 and seals against an outer surface 551 of the uphole completion tubing 539 to prevent any wellbore fluid 519 within the slick joint 539 and within a lumen 540 of the seal assembly 500 from flowing in a downhole direction out of the seal assembly 500 and into the annulus 517. The seal assembly 500 is a repairable system that includes a receptacle 502 (for example, an inverted receptacle) carrying an interior seal stack 514 along an inner surface 525. The seal stack 514 includes multiple annular components that are substantially similar in construction and function to like components of the seal assembly 100, except that the components are located along an inner surface 525 of the receptacle 502 as opposed to an outer surface of the body 102. For example, the seal assembly 500 includes multiple opposing seals 504, 506, multiple opposing metal spacers 508, 510 arranged alternatively with the seals, a transition ring 512 located axially between the opposing seals 504, 506 and opposing metal spacers 508, 510, and two anchors 518, 528 that flank the transition ring 512.

In an initial configuration, the transition ring 512 has an inner diameter that is larger than an outer diameter of the slick joint 539 such that the transition ring 512 does not contact the slick joint 539 to effect sealing in the initial configuration. Should one or more of the seals 504, 506 fail, then a tubing heater carried on an electric line can be deployed to the lumen 542 of the slick joint 539 to melt the transition ring 512 into a transitional configuration in which the molten material of the transition ring 512 is bounded by the downhole separator 518, the outer surface 551 of the slick joint 539, and the inner surface 525 of the receptacle 502. The tubing heater can subsequently be withdrawn from the slick joint 539 to allow the molten material to cool and solidify into a functional configuration that effects sealing with the outer surface 551 of the slick joint 539.

In all of the completion systems 101, 401, 501, the seal stacks 114, 314, 514 are provided on the component (for example, the bodies 102, 302, 502) that can be pulled from a wellbore, thereby enabling repair by a replace upper completion workover.

Other embodiments are also within the scope of the following claims.

What is claimed is:

1. A repairable seal assembly for deployment within a completion tubing system of a wellbore, the repairable seal assembly comprising:

an elongate body;

a first seal carried by the elongate body and configured to seal against an inner surface provided by a receptacle configured to be positioned within the completion tubing system and sized to receive the seal assembly;

a transitional component carried by the elongate body and being adjustable from a first configuration in which the transitional component defines a gap between the transitional component and the inner surface to a second configuration in which the transitional component contacts the inner surface to form a second seal at the adjacent surface;

a third seal carried by the elongate body and configured to seal against the inner surface provided by the receptacle, wherein the transitional component is between the first seal and the third seal;

a first anchor secured to the elongate body at a first fixed position between the first seal and the transitional component, wherein the transitional component is supported by the first anchor in the first configuration, and wherein the first anchor provides support for the first seal; and a second anchor secured to the elongate body at a second fixed position between the transitional component and the third seal, wherein the first anchor and the transitional component are detached in the second configuration, and wherein the second anchor at least partially defines a size and a shape of the transitional component in the second configuration.

2. The repairable seal assembly of claim 1, wherein the transitional component has an annular shape.

3. The repairable seal assembly of claim 1, wherein the transitional component comprises a metal alloy that has a melting point in a range of 90° C. to 300° C.

4. The repairable seal assembly of claim 3, wherein the transitional component is configured to be melted by a heater from the first configuration to the second configuration.

5. The repairable seal assembly of claim 4, wherein the transitional component is in a solid state in the first and second configurations, and wherein the transitional component is in a liquid state during a transitional period that occurs between a first period in which the transitional component is in the first configuration and a second period in which the transitional component is in the second configuration.

6. The repairable seal assembly of claim 3, wherein the transitional component has a melting point in a range of 20° C. to 200° C. above a maximum expected operational temperature at the wellbore.

7. The repairable seal assembly of claim 1, wherein the elongate body defines a lumen sized to allow passage of a heater.

8. The repairable seal assembly of claim 1, wherein the transitional component has a first diameter and a first length in the first configuration, wherein the transitional component has a second diameter and a second length in the second configuration, wherein the first diameter is less than the second diameter, and wherein the first length is greater than the second length.

9. The repairable seal assembly of claim 1, wherein the second seal is arranged to fluidically isolate a downhole region of a pipe surrounding the repairable seal assembly within the wellbore from an uphole annulus within the pipe.

10. The repairable seal assembly of claim 1, wherein the second seal provides metal-to-metal sealing with the inner surface.

11. The repairable seal assembly of claim 1, further comprising one or more additional first seals carried by the elongate body.

12. The repairable seal assembly of claim 1, further comprising one or more additional transitional components carried by the elongate body.

13. The repairable seal assembly of claim 1, wherein the first seal and the third seal are further configured to seal against an outer surface provided by a tube sized to be received within the seal assembly.

14. The repairable seal assembly of claim 1, further comprising one or more spacers arranged to support the first seal.

15. A completion system installed at a wellbore, the completion system comprising:

a tubular component providing an interface; and a repairable seal assembly positioned adjacent the interface, the seal assembly comprising:

an elongate body, a first seal carried by the elongate body and configured to seal against the interface, a transitional component carried by the elongate body and being adjustable from a first configuration in which the transitional component defines a gap between the transitional component and the interface to a second configuration in which the transitional component contacts the interface to form a second seal at the interface, a third seal carried by the elongate body and configured to seal against the interface, wherein the transitional component is between the first seal and the third seal, a first anchor secured to the elongate body at a first fixed position between the first seal and the transitional component, wherein the transitional component is supported by the first anchor in the first configuration, and wherein the first anchor provides support for the first seal, and a second anchor secured to the elongate body at a second fixed position between the transitional component and the third seal, wherein the first anchor and the transitional component are detached in the second configuration, and wherein the second anchor at least partially defines a size and a shape of the transitional component in the second configuration.

16. The completion system of claim 15, wherein the transitional component comprises a metal alloy that has a melting point in a range of 90° C. to 300° C.

17. The completion system of claim 16, wherein the transitional component is configured to be melted from the first configuration to the second configuration.

18. The completion system of claim 15, wherein the tubular component comprises a receptacle sized to receive the repairable seal assembly, and wherein the interface comprises an inner surface of the tubular component.

19. The completion system of claim 15, wherein the tubular component comprises a completion tubing sized to fit within the repairable seal assembly, and wherein the interface comprises an outer surface of the completion tubing.

20. A method of sealing a tubing system installed at a wellbore, the method comprising:

forming a first seal between a sealing element carried by an elongate body and a surface adjacent the elongate body, wherein the elongate body carries:

a first anchor secured to the elongate body at a first fixed position between the first seal and the transitional component, wherein the transitional component is supported by the first anchor in the first configuration, a second anchor secured to the elongate body at a second fixed position downhole of the first fixed position, wherein the transitional component is supported by the second anchor in the first configuration;

determining a failure of the first seal at the surface;

adjusting a transitional component carried by the elongate body from the first configuration in which the transitional component defines a gap between the transitional component and the surface to the second configuration in which the transitional component contacts the surface, wherein the anchor at least partially defines a size and a shape of the transitional component in the second configuration;

detaching the transitional component and the first anchor in the second configuration; and forming a second seal between the transitional component in the second configuration and the surface.

21. A repairable seal assembly for deployment within a completion tubing system of a wellbore, the repairable seal assembly comprising:

an elongate body;

a first seal carried by the elongate body and configured to seal against an inner surface provided by a receptacle configured to be positioned within the completion tubing system and sized to receive the seal assembly;

one or more spacers arranged to support the first seal;

a transitional component carried by the elongate body and being adjustable from a first configuration in which the transitional component defines a gap between the transitional component and the inner surface to a second configuration in which the transitional component contacts the inner surface to form a second seal at the adjacent surface;

a third seal carried by the elongate body and configured to seal against the inner surface provided by the receptacle, wherein the transitional component is between the first seal and the third seal;

a first anchor secured to the elongate body at a first fixed position between the first seal and the transitional component, wherein the transitional component is supported by the first anchor in the first configuration; and a second anchor secured to the elongate body at a second fixed position between the transitional component and the third seal, wherein the first anchor and the transitional component are detached in the second configuration, and wherein the second anchor at least partially defines a size and a shape of the transitional component in the second configuration.

* * * * *